US007903999B2

(12) United States Patent
Kinokuni et al.

(10) Patent No.: US 7,903,999 B2
(45) Date of Patent: Mar. 8, 2011

(54) IMAGE FORMING APPARATUS

(75) Inventors: Jiro Kinokuni, Abiko (JP); Kazufumi Muto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/575,669

(22) Filed: Oct. 8, 2009

(65) Prior Publication Data

US 2010/0092223 A1 Apr. 15, 2010

(30) Foreign Application Priority Data

Oct. 9, 2008 (JP) ..... 2008-262995

(51) Int. Cl.
*G03G 15/30* (2006.01)

(52) U.S. Cl. ..... 399/149; 399/129

(58) Field of Classification Search ..... 399/129, 399/149, 150, 343, 345, 350–354
See application file for complete search history.

(56) References Cited

U.S. PATENT DOCUMENTS

| | | | | |
|---|---|---|---|---|
| 6,694,122 | B2 | 2/2004 | Muto et al. | |
| 6,836,638 | B2 | 12/2004 | Muto et al. | |
| 7,469,116 | B2 * | 12/2008 | Kitajima | 399/129 |
| 7,620,340 | B2 | 11/2009 | Kinokuni | |
| 2007/0127944 | A1 * | 6/2007 | Mochizuki | 399/101 |

FOREIGN PATENT DOCUMENTS

| | | | |
|---|---|---|---|
| JP | 2003-167477 | A | 6/2003 |
| JP | 2005-234035 | A | 9/2005 |

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a photosensitive member; a developing device for developing an electrostatic image formed on said photosensitive member into a toner image; a transfer charger for transferring a toner image from said photosensitive member onto an image receiving member; a non-rotational brush and a rotatable brush for electrically charging toner, which remains on said photosensitive member after image transfer by said transfer charger, to collect the remaining toner into said developing device; a driving mechanism provided with a driving source for rotating said rotatable brush; and a moving mechanism for reciprocating said non-rotational brush by a driving force through said rotatable brush in a direction along an axis of said photosensitive member.

3 Claims, 2 Drawing Sheets

IMAGE FORMING APPARATUS

FIELD OF THE INVENTION AND RELATED ART

The present invention relates to an image forming apparatus such as a copying machine, a printer, a facsimile machine, or a multi-function machine having a plurality of functions of these machines.

In an image forming apparatus for effecting image formation by using an electrophotographic process, untransferred toner on a photosensitive member has been conventionally removed and collected by a cleaner. On the other hand, an image forming apparatus employing a so-called cleanerless system in which the untransferred toner on the photosensitive member is collected in a developing device without providing such a cleaner has been commercially available.

In such an image forming apparatus employing the cleanerless system, it has been practiced that the untransferred toner on the photosensitive member is electrically charged to enhance a collecting efficiency in the developing device. Specifically, in an apparatus disclosed in Japanese Laid-Open Patent Application (JP-A) 2003-167477, a constitution in which two non-rotational brushes are disposed in contact with the photosensitive member and are used to electrically charge the untransferred toner on the photosensitive member is employed.

In an apparatus described in JP-A 2003-167477, a mechanism for reciprocating the non-rotational brushes in an axial (shaft) direction of the photosensitive member (a so-called reciprocating mechanism) is provided in order to properly perform charging of the untransferred toner on the photosensitive member by the brushes. By employing such a mechanism for reciprocating the non-rotational brushes, it is possible to disperse the untransferred toner in a rotation axis direction of the photosensitive member. Therefore, it is possible to suppress local accumulation of the untransferred toner in an area of a part of the non-rotational brushes and thus to properly perform the charging of the untransferred toner. As a result, it is possible to enhance the collecting efficiency of the untransferred toner in the developing device.

In an apparatus described in JP-A 2005-234035, the collecting efficiency of the untransferred toner is further enhanced by using a non-rotational brush and a rotatable brush.

However, in the apparatus using the non-rotational brush and the rotatable brush as described in JP-A 2005-234035, in the case where the collecting efficiency of the untransferred toner in the developing device is intended to be further enhanced by reciprocating the non-rotational brush as in the apparatus described in JP-A 2003-167477, there is a possibility that an increase in cost occurs.

That is, in the case of providing a driving source exclusively for reciprocating the non-rotational brush in the axial direction in addition to a driving source for rotating the rotatable brush, it results in the increase in cost.

SUMMARY OF THE INVENTION

A principal object of the present invention is to provide an image heating apparatus capable of properly performing charging of untransferred toner without providing a driving source exclusively for reciprocating a non-rotational brush in an axial direction in addition to a driving source for rotating a rotatable brush.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, preferred embodiments of the present invention will be described.

Figure 1:
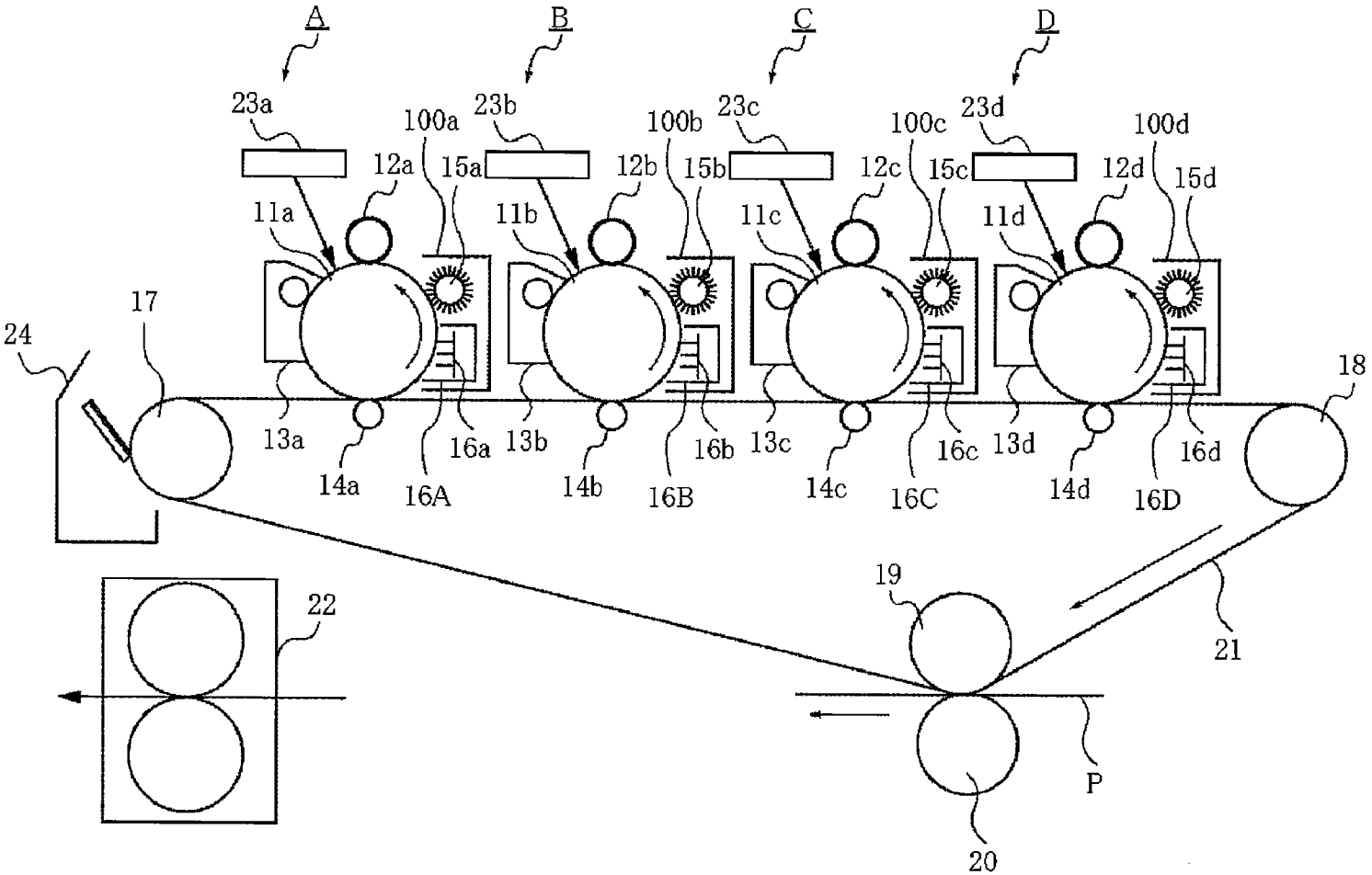
FIG. 1 is a schematic sectional view of an image forming apparatus including a cleanerless system.

FIG. 1 is a sectional view of a cleaner-less color printer (image forming apparatus), and shows the general structure of the printer. This color printer is structured to form a color image with the use of an electrophotographic process. First, the image forming portion of the color printer will be described.

(Image Forming Portion)

Referring to FIG. 1, the image forming apparatus in this embodiment is provided with four image formation stations (A, B, C, and D) as the image forming portions of the apparatus. The four image formation stations are the same in structure. Hereafter, therefore, only the image formation station A will be described in detail; the other image formation stations will not be described in detail. In terms of roles and functions, the image formation stations A, B, C, and D form images with the use of yellow, magenta, cyan, and black toners, respectively.

The image formation station A has a photosensitive member 11*a* as an image bearing member. The photosensitive member 11*a* is rotatable in the direction indicated by an arrow mark in the drawing. It is rotationally driven by a motor 62*a* (FIG. 2), which is the driving force source that functions as a part of the mechanism for driving the photosensitive member 11*a*. In this embodiment, an organic photosensitive member (OHP) is used as the photosensitive member 11*a*. In terms of the direction parallel to the axial line of the photosensitive member 11*a*, the area of the peripheral surface of the photosensitive member 11*a*, across which an image can be formed, is slightly wider than the dimension of a recording sheet P of A4 size, in its lengthwise direction.

The color printer is provided with a charging device 12*a*, an exposing apparatus 23*a*, a developing device 13*a*, a charging device 14*a* for first image transfer, and a pair of auxiliary charging devices 15*a* and 16*a*, which are disposed in the adjacencies of the peripheral surface of the photosensitive member 11*a*, in the listed order in terms of the rotational direction of the photosensitive member 11*a*. The auxiliary charging device 15*a* is in the form of a rotational brush, whereas the auxiliary charging device 16*a* is the form of a non-rotational bush.

As a print command reaches the color printer from an external host computer through network cables, the photosensitive member 11*a* begins to rotate. Then, the peripheral surface of the photosensitive member 11*a* is uniformly charged to the negative polarity (which is −600 V in this embodiment) by the charging device 12*a*. The charging device 12*a* in this embodiment is in the form of a charge roller. It contains an electrically conductive substance (ion-conductive substance) by such an amount that makes the electrical resistance (at normal temperature and normal humidity) of the charge roller 12*a* fall in a range of $10^5$-$10^7\Omega$. When charging the photosensitive member 11*a*, a charge bias, which is a combination of DC and AC voltages, is applied to the charge roller 12*a*. The charge bias in this embodiment is a combination of a DC voltage of −600 V, and an AC voltage which is 2 KHz in frequency and 1.5 KV in peak-to-peak voltage.

Then, a beam of laser light is projected upon the peripheral surface of the photosensitive member 11*a* by an exposing apparatus 23*a*, while being modulated with the image formation data inputted from the host computer. As a result, an electrostatic image, which reflects the image formation data, is formed on the peripheral surface of the photosensitive member 11*a*. The image formation data are inputted into the printer when the aforementioned print command is inputted.

Then, the electrostatic image formed on the photosensitive member 11*a* as described above is made visible by the developing device 13*a*, which uses yellow toner. During this process, a development bias (which is −300 V of DC voltage in this embodiment) is applied to the development roller of the developing device 13*a* from a high voltage source. In the case of the development method used in this embodiment, the normal polarity to which the photosensitive member 11*a* is charged, and the normal polarity to which the toner is charged, are both negative, that is, being the same in polarity. In other words, the image forming apparatus in this embodiment uses a so-called reverse development method. Incidentally, a combination of a DC voltage and an AC voltage may be applied as the development bias, in order to improve the apparatus in development efficiency. The amount of charge given to the yellow toner stored in the developing device is in a range of −25 to −36 μC/mg. Further, in order to adjust the yellow toner in fluidity, silica that is 20 nm in particle diameter and has been treated with oil has been added to the yellow toner. The ratio by which the silica is added is no more than 30%.

Then, the yellow toner image formed on the photosensitive member 11*a* is transferred (first transfer) onto an intermediary transfer belt 21 (transfer medium) by the first transfer charging device 14*a* (transfer charger). For this transfer, a first transfer bias (+500 V in this embodiment) is continuously applied to the first transfer charger 14*a*, which is the form of a roller (transfer roller) in this embodiment.

After the completion of the first transfer, the toner remaining on the photosensitive member 11*a* (which hereafter will be referred to as transfer residual toner), that is, the toner having failed to be transferred onto the intermediary transfer belt 12 from the photosensitive member 11*a*, is charged by the non-rotational brush 16*a*, and then, by the rotational brush 15*a*, as will be described later.

As the charged transfer residual toner reaches where it faces the developing device 13*a*, it is electrostatically recovered by the developing device 13*a*. For the recovery of the transfer residual toner, the development bias is applied to the development roller of the developing device 13*a*. In the case of a job in which two or more images are continuously formed, the electrostatic images are formed on the photosensitive member 11*a* while the transfer residual toner is recovered from the photosensitive member 11*a* by the developing device 13*a*. That is, the above described development process and transfer residual toner recovery process are simultaneously carried out.

Described above is the image formation sequence carried out in each of the image formation stations.

The intermediary transfer belt 21, onto which a visible image formed in each image formation station is transferred, is below the image formation stations A-D. It is suspended, and remains stretched, by the intermediary transfer belt rollers 17-19. It is circularly driven in the direction indicated by an arrow mark in the drawing, by the intermediary transfer belt roller 17, which also functions as the belt driving roller. The intermediary transfer belt 21 is formed of PI (polyimide) resin. It is 5 μm in thickness, and its volume resistivity is in a range of $10^9$-$10^{10}$ Ω×cm.

An image formation process, which is similar to the above described one, is carried out in each of the other image formation stations B-D. Then, the four toner images formed in the image formation stations A-D, one for one, are sequentially transferred in layers (first transfer) onto the intermediary transfer belt 21, forming thereby a full-color toner image on the intermediary transfer belt 21.

After being formed as described above, the four monochromatic toner images of the full-color toner image are transferred together (second transfer) by the second transfer charging device 20, onto a sheet P, which is a sheet of recording medium. For this transfer, a second transfer bias (which is +1000 V in this embodiment) is applied to the transfer roller, which is the second transfer charging device 20. After the second transfer, the toner remaining on the intermediary transfer belt 21 is removed by a cleaner 24, and is recovered by the cleaner 24, to be used for the following image formation.

Thereafter, the full-color image formed on the sheet P is fixed to the sheet P by being heated and pressed by a fixing apparatus 22. After being subjected to the fixing operation, the sheet P is discharged from the image forming apparatus, ending the image formation.

(Cleaner-Less System for Cleaning Photosensitive Drum)

Next, the photosensitive drum cleaning system in this embodiment will be described, which does not have a cleaner dedicated to the cleaning of the photosensitive drum. The four photosensitive drum cleaning systems employed by the four image formation stations A-D, one for one, are identical. Therefore, only the cleaner-less photosensitive drum cleaning system of the image formation station A will be described in detail; the cleaner-less photosensitive drum cleaning systems in other image formation stations will not be described.

The transfer residual toner, that is, the toner which failed to be transferred (first transfer) from the photosensitive member 11*a* by the first transfer charging device 14*a* and is remaining on the photosensitive member 11*a*, is charged, first, by the non-rotational brush 16*a* (auxiliary charging device), and then, is charged by the rotational brush 15*a* (auxiliary charging device). The non-rotational brush 16*a* and rotational brush 15*a*, which are the auxiliary charging devices, are kept within a cover 100*a* for the auxiliary charging devices, which is roughly U-shaped in cross section (FIG. 1).

In terms of the charging the transfer residual toner, the rotational brush 15*a* is higher in performance than the non-rotational brush 16. In this embodiment, therefore, in order to properly charge the transfer residual toner, the rotational brush 15*a* is used as the second auxiliary charging device for charging the transfer residual toner.

Hereafter, the non-rotational brush 16*a* and rotational brush 15*a* will be described in detail.

(Non-Rotational Brush)

The non-rotational brush 16*a* in this embodiment is a so-called deck brush, which is made up of a supporting board, and nylon fibers. The nylon fibers are 6 denier in thickness, 5 mm in length, and 100 KF in density. The nylon fibers contain the carbon dispersed therein as an electrical resistance adjustment agent; the volume resistivity of the nylon fibers has been adjusted to be in a range of $10^5$-$10^6$ Ω×cm. By the way, the nylon fiber to be used as the material for the non-rotational brush 16*a* may be a nylon fiber, the electrical resistance of which has been adjusted by coating the fiber with carbon.

The non-rotational brush 16*a* is fixed to the holder 16A, which is roughly U-shaped in cross section. The holder 16A is attached to the cover 100*a* for the auxiliary charging devices (non-rotational and rotational brushes 16*a* and 15*a*) so that the holder 16A is not allowed to rotate, and also, so that the fiber portion of the non-rotational brush 16*a* remains in contact with the photosensitive member 11*a*. That is, the relationship between the non-rotational brush 16*a* and photosensitive member 11*a* is such that as the photosensitive member 11*a* is rotated, the non-rotational brush 16*a* rubs the peripheral surface of the photosensitive member 11*a* (while charging transfer residual toner). Further, the holder 16A is supported by a shaft attached to the cover 100*a* so that the holder 16A is allowed to move back and forth in the direction parallel to the rotational axis of the photosensitive member 11*a* while holding the non-rotational brush 16*a*, as will be described later.

By the way, the material for the non-rotational brush 16*a* may be polyester fibers. Further, the fibers are desired to be 2-10 denier in thickness, 3-8 mm in length, and 50-500 KF in pile density.

The fiber supporting plate of the non-rotational brush 16*a* is in connection with a high voltage power source, which is for applying to the non-rotational brush 16*a*, a charge bias (first auxiliary charge bias) which is opposite in polarity to the normal polarity to which the toners are charged. In this embodiment, +600 V of DC voltage is applied as the first auxiliary charge bias. Further, for reliability, an AC voltage (which is 400 V in peak-to-peak voltage, for example) may be applied in combination with the DC voltage.

(Rotational Brush)

The rotational brush 15*a* in this embodiment is made up of a piece of pile formed of nylon fiber, and an electrically conductive base to which the pile is planted. The nylon fibers are 6 denier in thickness, and are 10 mm in length. The pile is 100 KF in fiber density. The electrically conductive base is attached to a hollow metallic core, which is rotatably supported. That is, the rotational brush 15*a* is in the form of a roller.

In this embodiment, the rotational brush 15*a* is rotationally disposed so that its fibrous portion remains in contact with the photosensitive member 11*a*. By the way, the material for the rotational brush 15*a* may be polyester fiber. If the polyester fiber is used as the brush material, it is desired to be 2-10 denier in thickness, 5-10 mm in length, and the fiber density is desired to be in a range of 50-500 KF. Further, this nylon fiber contains carbon dispersed therein as electrical resistance adjustment agent; the volumetric resistivity of the fiber has been set to be in a range of $10^5$-$10^6$ Ω×cm. By the way, the nylon fiber to be used as the material for the rotational brush 15*a* may be a nylon fiber, the electrical resistance of which has been adjusted by coating the surface of the fiber with carbon.

The metallic core portion of the rotational brush 15*a* is in connection to a high voltage power source so that the second auxiliary charge bias, which is the same in polarity as the normal polarity of the toners, is applied to the metallic core portion. In this embodiment −1000 V of DC voltage is applied as the second auxiliary charge bias.

Next, the reason why the above described cleaner-less photosensitive drum cleaning system was employed in this embodiment will be described.

The transfer residual toner on the photosensitive member 11*a*, that is, the toner having failed to be transferred (first transfer) and remaining on the photosensitive member 11*a*, contains two kinds of toner, that is, the normally charged toner (negatively charged toner) and the so-called reversal toner (positively charged toner), or the toner which is opposite in polarity from the normally charged toner.

In order to electrostatically and efficiently recover the transfer residual toner on the photosensitive member 11*a*, into the developing device 13*a*, it is required to make all the transfer residual toner normal (negative) in polarity, and roughly the same (−25-35 μC/mg) in the amount of charge. On the other hand, in order to charge the transfer residual toner so that all the transfer residual toner becomes normal in polarity, and has a preset amount of charge, it is desired to charge (first auxiliary charging process) the transfer residual toner to the reverse polarity (positive polarity) before charging the transfer residual toner to the negative polarity.

In this embodiment, therefore, the bias which is opposite in polarity to the normal bias applied to the charging device is applied to the non-rotational brush 16*a*, whereas the bias which is the same (negative) in polarity as the normal bias applied to the charging device is applied to the rotational brush 15*a*.

Further, the secondary auxiliary charge bias is set so that the potential level to which the photosensitive member 11*a* is charged by the application of the auxiliary charge bias (−1000 V) will be smaller in absolute value than the potential level to which the photosensitive member 11*a* is charged by the application of the bias (−600 V) to the charging device 12*a*. This setting is for preventing the problem that after the transfer residual toner is negatively charged by the rotational brush 15*a*, it electrostatically transfers onto the charging device 12*a* when the photosensitive member 11*a* is charged by the charging device 12*a*.

The above described charging of the transfer residual toner, and recovery of the transfer residual toner recovery into the developing device, are also carried out in the other image formation stations B-D.

(Driving Mechanism)

Figure 2:
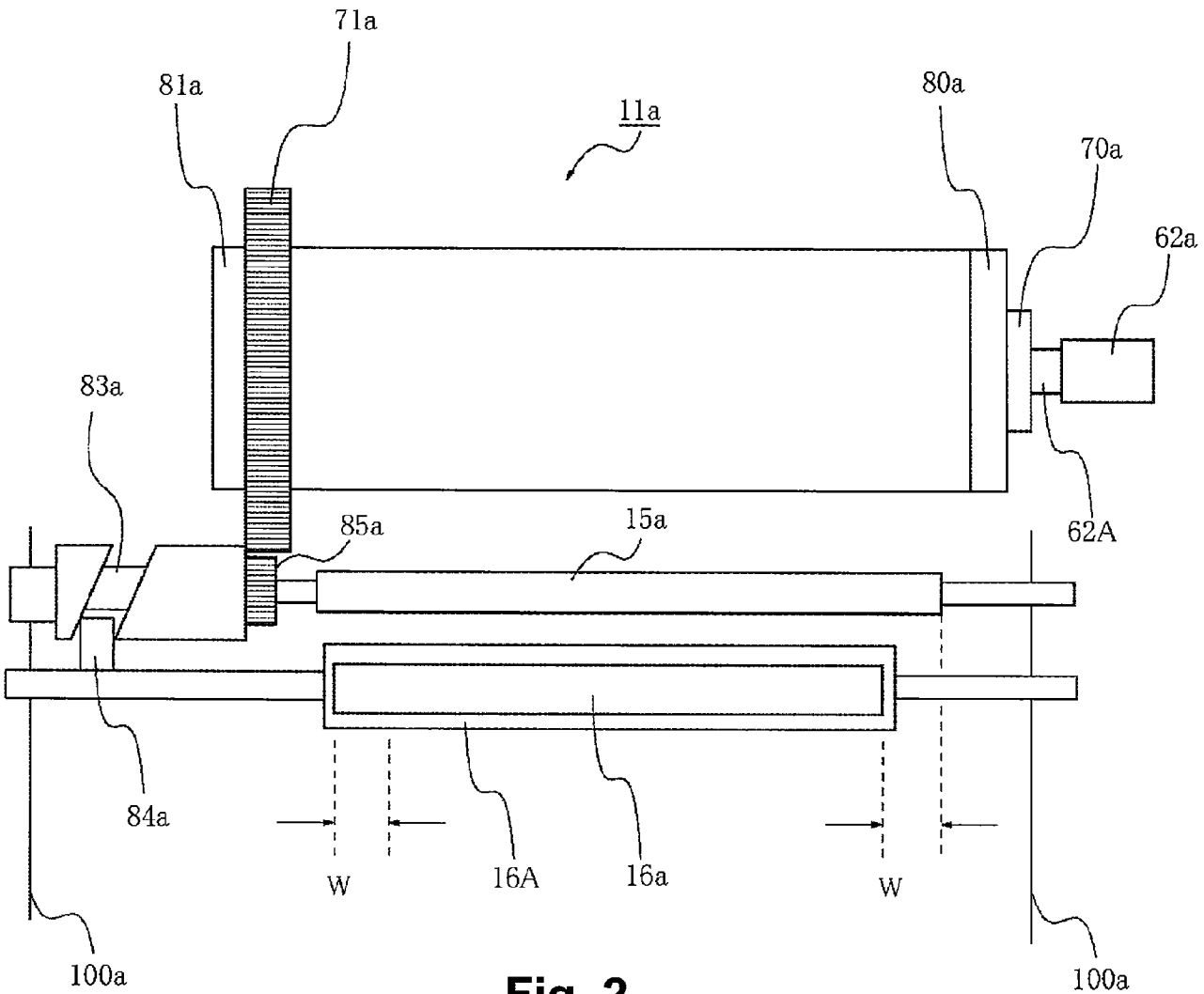
FIG. 2 is a schematic sectional view showing a driving mechanism for a photosensitive member, a non-rotational brush, and a rotatable brush.

Next, referring to FIG. 2, the driving mechanism for rotationally driving the rotational brush 15*a* will be described. Since the four rotational brush driving mechanisms employed by the four image formation stations, one for one, are the same in mechanism, only the rotational brush driving mechanism of the image formation station A will be described in detail; the other rotational brush driving mechanisms will not be described.

In this embodiment, the photosensitive drum cleaning system is not structured to directly input driving force to the rotational brush 15*a* from a driving force source. Instead, it is structured so that the rotational brush 15*a* receives rotational driving force from the driving force source by way of the photosensitive member 11*a*. More specifically, the image forming apparatus in this embodiment is structured so that the photosensitive member 11*a* and rotational brush 15*a* share a single driving force source. Not only can this setup reduce the apparatus in cost, but also, in size.

More concretely, the driving force transmission mechanism for rotationally driving the photosensitive member 11*a* is structured as follows. The driving force transmission mechanism has: a motor 62*a* as a driving force source; and a coupling 62*a* attached to the drive shaft of the motor 62*a*.

The one end of the rotational axle of the photosensitive member 11*a* is provided with a flange 80*a*, which has a coupling 70*a*. The image forming apparatus is structured so that this coupling 70*a* is connectible to the aforementioned coupling 61A to transmit the rotational driving force from the motor 62*a* to the photosensitive member 11*a*. Thus, as the motor 62*a* is activated by the CPU as a controller, the photosensitive member 11*a* rotates at a preset peripheral velocity in the direction indicated by an arrow mark in the drawing.

Further, in this embodiment, the image forming apparatus is provided with a mechanical linkage for driving the rotational brush 15*a* with the use of the driving force that drives the photosensitive member 11*a*. More concretely, the mechanical linkage has an driving force output gear 71*a*, which is attached to a flange 81*a*, which is attached to the opposite end of the photosensitive member 11*a* from the coupling 70*a* in terms of the axial direction of the photosensitive member 11*a*. The mechanism linkage has also a driving force input gear 85*a*, with which the rotational axle of the rotational brush 15*a* is provided. This driving force input gear 85*a* is in engagement with the driving force output gear 71*a*.

The rotational brush 15*a* is rotationally borne at its lengthwise end portions, by the cover 100*a* for the auxiliary charging devices. Further, the rotational brush 15*a* is held to the cover 100*a* to make it virtually impossible for the rotational brush 15*a* to move in its lengthwise direction.

In other words, the image forming apparatus is structured so that the rotational brush 15*a* is rotated by the rotational force transmitted to the rotational brush 15*a* by way of the photosensitive member 11*a*. Further, the rotational brush 15*a* is connected to the photosensitive member 11*a* through the gear 85*a* and 71*a* so that the peripheral surface of the rotational brush 15*a* moves in the same direction as the peripheral surface of the photosensitive member 11*a*, in the area of contact (charging area) between the peripheral surface of the rotational brush 15*a* and the peripheral surface of the photosensitive member 11*a*. Further, the gear ratio between the gears 71*a* and 85*a* is set so that the rotational brush 15*a* rotates at a peripheral velocity which is higher than the peripheral velocity of the photosensitive member 11*a*. In other words, the following phenomenon has been taken into consideration. That is, when the tip portion of each fiber of the rotational brush 15*a* leaves the photosensitive member 11*a*, it is made to flip away from the photosensitive member 11*a*, by its own resiliency, and therefore, the transfer residual toner in the rotational brush 15*a* is spitted out toward the photosensitive member 11*a*. Thus, this setup makes it possible to prevent the problem that the amount by which the transfer residual toner remains in the rotational brush 15*a* after being taken into the rotational brush 15*a* increases.

The rotational brush driving mechanisms in the other image formation stations B-D are the same as the rotational brush driving mechanism in the image formation station A, which was described above. That is, they also are structured so that rotational brushes 15*b*-15*d* charge (second auxiliary charge) the transfer residual toner on the photosensitive members 11*b*-11*d*, respectively, while rotating, as does the rotational brush 15*a*.

(Brush Reciprocating Mechanism)

Next, referring to FIG. 2, the mechanism for reciprocally moving the non-rotational brush 16*a* in the direction parallel to rotational axis the photosensitive member 11*a* will be described. Since the four image formation stations are the same in the mechanism for reciprocally moving their non-rotational brushes 16, only the mechanism in the image formation station A will be described in detail; those in the other image formation stations will not be described.

In order to deal with such a situation that in terms of the direction parallel to the rotational axis of the photosensitive member 11*a*, some portions of the peripheral surface of the photosensitive member 11*a* collect more transfer residual toner than the other, the image forming apparatus in this embodiment is structured so that the non-rotational brush 16*a* can be reciprocally moved in the direction parallel to the axial line of the photosensitive member 11*a*. The employment of a mechanism for reciprocally moving the non-rotational brush 16*a* makes it possible to disperse the transfer residual toner on the photosensitive member 11*a*, in the direction parallel to the axial line of the photosensitive member 11*a*. In other words, the employment makes it possible to prevent the transfer residual toner from unevenly accumulating in the rotational brush 15*a* in terms of the direction parallel to the axial line of the rotational brush 15*a*. Therefore, the employment of this mechanism for reciprocally moving the non-rotational brush 16*a* makes it possible to keep the rotational brush 15*a* as high as possible in its charging performance (second auxiliary charge), which in turn makes it possible keep as high as possible the efficiency with which the transfer residual toner is recovered from the photosensitive member 11*a* into the developing device 13*a*. Therefore, it becomes possible for the photosensitive member 11*a* to be properly charged by the charging device 12*a*; it becomes possible to charge the photosensitive member 11*a* at a highest level of uniformity in potential level, in terms of the lengthwise direction of the photosensitive member 11*a*.

In this embodiment, the mechanism for reciprocally moving the non-rotational brush 16*a* is not provided with a driving force source dedicated to the non-rotational brush 16*a*. Instead, the image forming apparatus is structured so that the driving force from the motor 62*a* is used for reciprocally moving the non-rotational brush 16*a*. That is, the structural arrangement employed in this embodiment for reciprocally moving the non-rotational brush 16*a* is such that the driving force inputted into the photosensitive member 11*a* from the motor 62*a* is outputted to the rotational brush 15*a*, and then, the driving force inputted into the rotational brush 15*a* is inputted into the non-rotational brush 16*a*. That is, the driving force for rotating the photosensitive member 11*a* is also used as the driving force source for reciprocally moving the non-rotational brush 16*a*. In other words, not only can the present invention reduce an electrophotographic image forming apparatus in cost, but also, in size.

More concretely, the rotational shaft of the rotational brush 15*a* is provided with a cam 83*a* (groove) in addition to the driving force input gear 85*a*. Thus, as the rotational driving force from the motor 62*a* is inputted into the rotational brush 15*a* by way of the photosensitive member 11*a*, the cam 83*a* rotates with the rotational brush 15*a*.

The holder 16A, which holds the non-rotational brush 16*a*, is provided with a pair of shafts, which extend from the lengthwise ends of the holder 16A, one for one, in the direction parallel to the axial line of the holder 16A. Further, the end portion of one of the two shafts of the holder 16A is provided with a boss 84*a*, which is in engagement with the cam 83*a* (groove) of the rotational brush 15*a*. The two shafts of the holder 16A are borne by the cover 100*a* of the auxiliary charging devices in such a manner that they can be reciprocally moved together. Therefore, the non-rotational brush 16*a* is reciprocally moved by the driving force inputted into the non-rotational brush 16*a* from the motor 62*a* by way of the photosensitive member 11*a* and rotational brush 15*a*. The two ranges indicated by two referential letters W are the ranges in which the lengthwise ends of the non-rotational brush 16*a* reciprocally move, respectively. In terms of the lengthwise direction of the photosensitive member 11*a*, the range across which the non-rotational brush 16*a* is enabled to contact the peripheral surface of the photosensitive member 11*a* is slightly wider than the area of the photosensitive member 11*a*, across which an image can be formed. The reciprocal range W of the non-rotational brush 16*a* can be adjusted by changing the angle of the cam 83*a*.

In terms of the above described mechanism for reciprocally moving the non-rotational brush, the other image formation stations B-D are the same as the image formation station A. That is, the other image formation stations B-D are structured so that the non-rotational brushes 16*b*-16*d* charge the photosensitive members 11*b*-11*d*, respectively, while reciprocally moving, as does the non-rotational brush 16*a*.

This embodiment of the present invention makes it possible to reduce en electrophotographic image forming apparatus in cost and size, and also, to simplify the image forming apparatus in structure, by employing the above described driving force inputting mechanism for reciprocally moving the non-rotational brush 16.

(Verification)

Next, the results of the verification of this preferred embodiment of the present invention, which was obtained by continuously forming 1,000 prints, using the sheets P of A4 size, will be described.

More specifically, identical prints, which are high in image density across a certain range in terms of the direction parallel to the rotational axis of the photosensitive member 11*a* (identical prints of image having long stripe which is 5 cm wide in terms of lengthwise direction of photosensitive member) were continuously formed.

Since the image forming apparatus in this embodiment was structured so that the transfer residual toner was dispersed in the direction parallel to the rotational axis of the photosensitive member, the problem that the transfer residual toner is not recovered into the developing device, did not occur even at the end of the printing operation in which 1,000 identical prints was made using the sheets P of A4 size.

On the other hand, in the case of a comparative image forming apparatus, which was not structured to reciprocally move the non-rotational brush, it was impossible for the transfer residual toner to be dispersed in the direction parallel to the rotational axis of the photosensitive member. Thus, the phenomenon that the transfer residual toner fails to be recovered into the developing device began to occur when roughly the 100th print was made using the sheets P of A4 size. Some transfer residual toner transferred onto the sheet P, which resulted in the formation of unsatisfactory images.

That is, the effect of reciprocally moving the non-rotational brush was confirmed.

In the case of the image forming apparatus in the above described preferred embodiment of the present invention, the rotational brushes 15*a*-15*d* are not reciprocally moved in the direction parallel to the rotational axes of the photosensitive members 11*a*-11*d*, respectively, for the following reason.

That is, the non-rotational brush in this embodiment bears the role of the first auxiliary charging device for charging the transfer residual toner. Therefore, even if the non-rotational bush unsatisfactorily charges the transfer residual toner because of the flattening of its pile, there is not going to be a large problem, because, in order to compensate for the incomplete charging of the transfer residual toner by the non-rotational brush, the image forming apparatus is structured so that after the transfer residual toner is charged (first auxiliary charge) by the non-rotational brush, it is charged (second auxiliary charge) again by the rotational brush.

On the other hand, the rotational brush bears the role of carrying out the final process of charging the transfer residual toner. Therefore, if it fails to satisfactorily charge the transfer residual toner because of the flattening of its fibrous pile, the transfer residual toner is not going to be satisfactorily recovered. In other words, there is direct connection between the unsatisfactory charging of the transfer residual toner by the rotational brush and the unsatisfactory recovery of the transfer residual toner.

Further, if the image forming apparatus in this embodiment is structured so that the rotational brush also is reciprocally moved, it is possible that the rotational brush will be deformed in a manner to negatively affect the charging performance of the rotational brush. Thus, the structural arrangement for reciprocally moving the rotational brush is not employed in this embodiment. Therefore, the moment the tip of each fiber of the rotational brush separates from the photosensitive drum, it flips up, and as it flips up it flings the transfer residual toner back onto the photosensitive drum. Further, it is reasonable to think that this effect will last for a long time.

As described above, the present invention makes it possible to structure an electrophotographic image forming apparatus so that the non-rotational brush of the apparatus is reciprocally moved without providing the apparatus with a driving force source dedicated to the reciprocal movement of the rotational brush. Thus, the present invention makes it possible to reduce an electrophotographic image forming apparatus in cost and size, and also, to simplify the apparatus.

In the preferred embodiment described above, a single driving force source was shared by the photosensitive drum and rotational brush. This setup, however, is not mandatory. For example, the photosensitive drum and rotational brush may be provided with their own driving power source, and the non-rotational bush may be reciprocally moved using the driving force which is directly inputted into the rotational brush from the driving force source dedicated to the rotational brush. From the standpoint of reducing an electrophotographic image forming apparatus in cost and size, and simplifying the apparatus, the structural setup in the preferred embodiment is preferable.

Further, in the preferred embodiment, a cam was used to convert the rotational force from the rotational brush, into the force for reciprocally move the non-rotational brush. However, this setup is not mandatory. That is, any of known mechanisms capable of making the same conversion as that in this preferred embodiment may be employed.

In the preferred embodiment, a toner image formed in each of the image formation stations was transferred onto the intermediary transfer belt (first transfer), and then, is transferred (second transfer) from the intermediary transfer belt onto a sheet of recording medium. However, this setup is not mandatory for the application of the present invention.

For example, the present invention is also applicable to an electrophotographic image forming apparatus which is provided with a recording medium conveying belt, instead of the intermediary transfer belt, and in which a toner image formed in each of the image formation stations is directly transferred onto the sheet of recording medium being conveyed by the recording medium conveying belt. In this case, the sheet of recording medium functions as the only recording medium to which an image is transferred.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 262995/2008 filed Oct. 9, 2008 which is hereby incorporated by reference.

What is claimed is:

1. An image forming apparatus, comprising:

a photosensitive member;

a developing device for developing an electrostatic image formed on said photosensitive member into a toner image;

a transfer charger for transferring a toner image from said photosensitive member onto an image receiving member;

a non-rotational brush and a rotatable brush for electrically charging toner remaining on said photosensitive member after image transfer by said transfer charger, to collect the remaining toner into said developing device;

a driving mechanism provided with a driving source for rotating said rotatable brush; and a moving mechanism for reciprocating said non-rotational brush by a driving force through said rotatable brush in a direction along an axis of said photosensitive member.

2. An apparatus according to claim 1, wherein said moving mechanism includes a cam portion provided on a shaft of said rotatable brush, and an engaging portion engaged with said cam portion to reciprocate said non-rotational brush with rotation of said rotatable brush.

3. An apparatus according to claim 1, wherein said driving mechanism includes a drive transmission mechanism for transmitting the driving force of said driving source to said photosensitive member, and a driving connection mechanism for driving connection between said photosensitive member and said rotatable brush to rotate said rotatable brush with rotation of said photosensitive member.

* * * * *